US006125256A

United States Patent [19]

Ni et al.

[11] Patent Number: 6,125,256

[45] Date of Patent: Sep. 26, 2000

[54] APPARATUS AND METHOD FOR REDUCING MEDIA WRINKLING IN AN IMAGING APPARATUS

[75] Inventors: Beta Y. Ni, Sherwood, Oreg.; Paul J. Menzel, University Park, Pa.

[73] Assignee: Xerox Corporation, Stamford, Conn.

[21] Appl. No.: 09/168,313

[22] Filed: Oct. 7, 1998

[51] Int. Cl.[7] ..... G03G 15/20

[52] U.S. Cl. ..... 399/322; 399/400

[58] Field of Search ..... 399/322, 400; 271/2; 219/216

[56] References Cited

U.S. PATENT DOCUMENTS

| | | | |
|---|---|---|---|
| 4,963,943 | 10/1990 | Tamary | 355/290 |
| 5,130,752 | 7/1992 | Morishita et al. | 355/274 |
| 5,159,394 | 10/1992 | Jinzai | 399/324 |
| 5,220,351 | 6/1993 | Martin et al. | 346/76 |
| 5,247,336 | 9/1993 | Mills, III | 355/285 |
| 5,406,360 | 4/1995 | Asai | 355/274 |
| 5,406,362 | 4/1995 | Mills | 355/285 |
| 5,495,276 | 2/1996 | Mul et al. | 347/164 |
| 5,678,160 | 10/1997 | Williams | 399/400 |
| 5,693,243 | 12/1997 | Kueppers et al. | 219/216 |
| 5,717,836 | 2/1998 | Horie | 395/101 |
| 5,933,694 | 8/1999 | Yamashita et al. | 399/322 |

FOREIGN PATENT DOCUMENTS 58-187971 11/1983 Japan .

OTHER PUBLICATIONS

U.S. Patent Application, Apparatus and Method for Controlling Media Temperature in a Imaging Apparatus, P.J. Menzel et al, 21 p., SN 09/073,069.

*Primary Examiner*—Joan Pendegrass

*Attorney, Agent, or Firm*—Charles F. Moore; Oliff & Berridge

[57] ABSTRACT

An improved apparatus and method for reducing media wrinkling, especially in envelopes, caused by transport through a fusing nip are provided. To compensate for stress build up in the media as it travels through the fusing nip, the media is bent or "pre-stressed" in a direction opposite to the nip stress prior to the media entering the fusing nip. A media support surface is positioned upstream from the fusing nip to pre-stress the media by providing pre-nip bending to the media. The media is bent in a direction opposite to the curvature of the harder nip roller prior to the media entering the fusing nip. This pre-nip bending of the media substantially offsets the nip-stress imparted on the media by the fusing nip.

12 Claims, 5 Drawing Sheets

FIG. 2
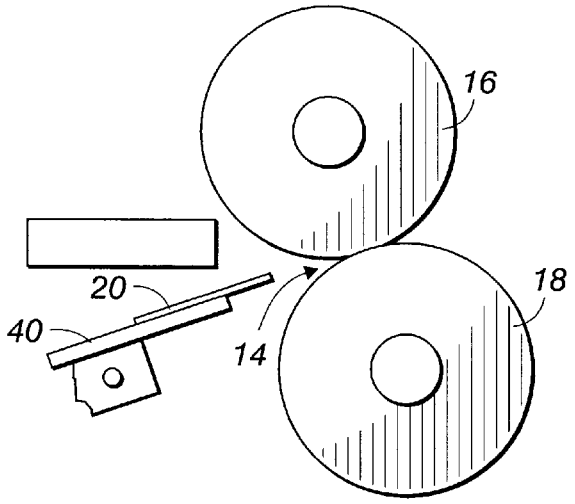
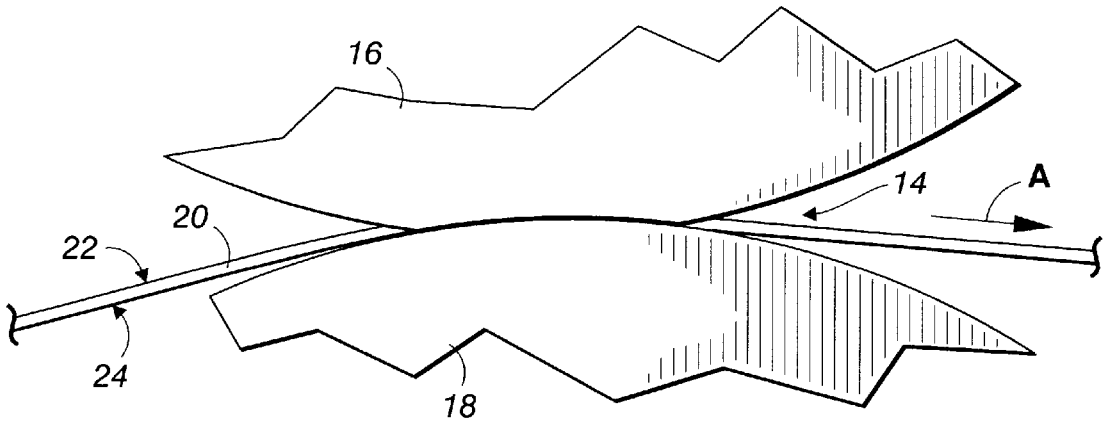
FIG. 3

FIG. 4
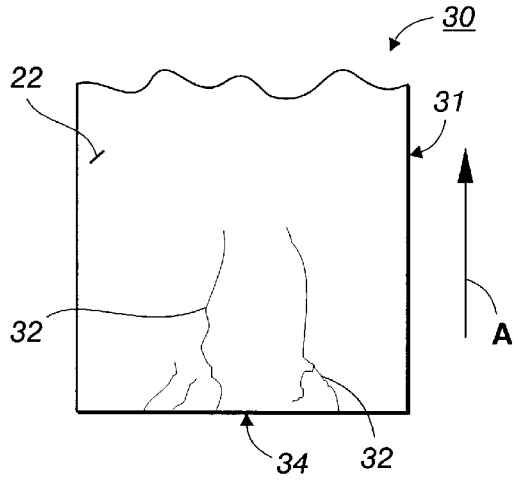
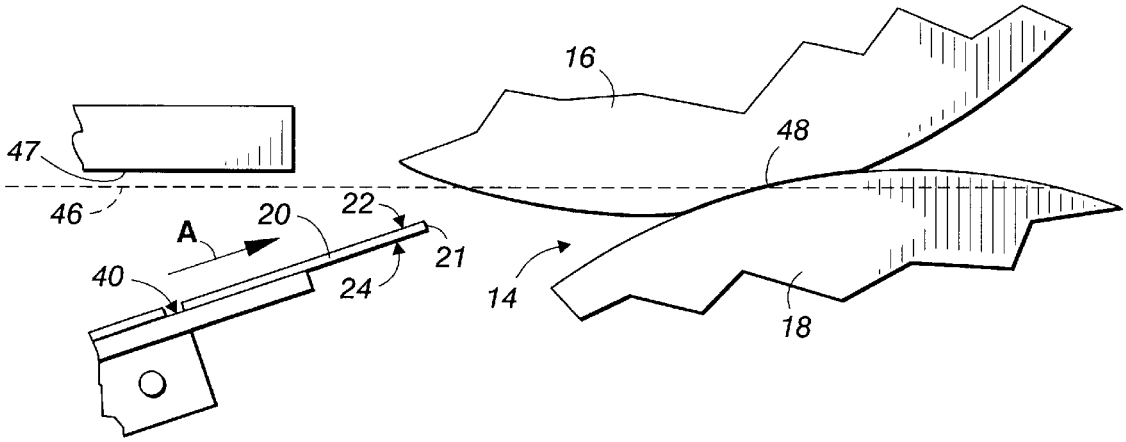
FIG. 5

FIG. 6
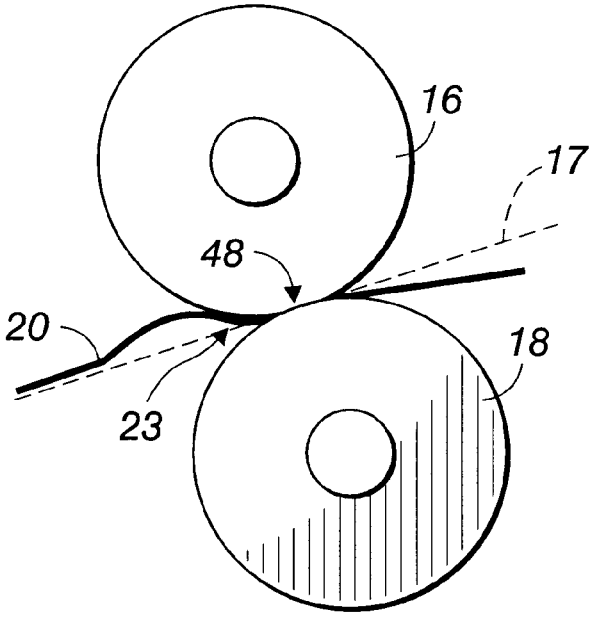
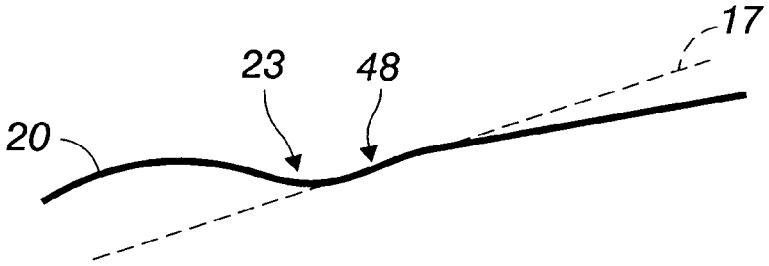
FIG. 7

APPARATUS AND METHOD FOR REDUCING MEDIA WRINKLING IN AN IMAGING APPARATUS

FIELD OF INVENTION

This invention relates generally to a method and apparatus for transporting media through a fusing nip in an image forming apparatus and, more specifically, to a method and apparatus for minimizing media wrinkling and related media transport problems in an image forming apparatus.

BACKGROUND OF THE INVENTION

In image forming apparatus such as laser printers, photocopiers, ink jet printers and the like, it is well known to pass imaged media through a fusing nip to fuse the image into the media. The fusing nip is typically created by biasing two rollers together. In some fusing systems one or both rollers are positively heated. In those systems having one roller that is positively heated, the side of the media containing the unfused toner or ink image is contacted by the heated roller to fuse the image into the media. The fusing process thus utilizes a combination of elevated temperature and pressure within the fusing nip to accomplish the desired amount of image fusing.

In some cases the fusing rollers will have different hardnesses. For example, the heated roller may have a lower hardness than the pressure (non-heated) roller. This nip geometry creates a nip-induced curvature or stress in the media that causes the media to bend or curl toward the pressure roller upon exiting the fusing nip. This nip geometry favors media release from the heated roller by directing the media away from the heated roller. The fusing nip may also have an opposite geometry, such that the pressure roller has a lower hardness than the heated roller. This nip geometry tends to favor duplex printing by bending or stressing the media toward the harder heated roller upon exiting the fusing nip. In this manner, the first image side of the media that is contacted by the pressure roller during its second pass through the fusing nip is directed away from the pressure roller to avoid image offset and to prevent the media from wrapping around the pressure roller.

Media speed within the fusing nip is governed by the roller surface velocities within the nip ("nip velocity"). The surface velocity of a roller is the combination of the roller free surface velocity and the roller surface deformation rate within the nip. Media wrinkling can be caused by any differential nip velocities across the media width. For example, if the rollers drive the center of the media faster than the media edges, or one edge faster than the other edge, media wrinkling may occur. Reducing the variation of nip velocity across the roller length has proved effective in reducing media wrinkling in most types of media. However, envelope wrinkling may still occur even when the differential nip velocity is at a minimal level.

In a fusing nip formed by rollers having different hardnesses, the surface velocity of the softer roller will be greater than the surface velocity of the harder roller due to the surface deformation of the softer roller. In the case of an envelope being transported through the nip, this nip geometry causes the envelope surface adjacent to the soft roller to move faster than the envelope surface adjacent to the hard roller. This creates a relative slip between the top and bottom layers of the envelope. Because these layers are affixed around their periphery and thereby prevented from slipping relative to one another, the differential velocities create increasing stress at the trailing end of the envelope as the envelope moves through the fusing nip. This stress creates wrinkles at the trailing end of the envelope.

The present invention seeks to reduce media wrinkling, especially in envelopes, caused by transport through a fusing nip by providing a method and apparatus for reducing stress build up in the media as it travels through the fusing nip. To compensate for the nip stress created by differential roller surface velocities, the media is bent or "pre-stressed" in a direction opposite to the nip stress prior to the media entering the fusing nip. A media support surface is positioned upstream from the fusing nip to "pre-stress" the media by providing pre-nip bending to the media. The end of the support surface nearest the nip is spaced from the nip-induced curvature of the media. In this manner, the media is bent prior to entering the nip in a direction opposite to the nip-induced curvature of the media. This pre-nip bending of the media substantially offsets the nip-stress imparted on the media by the fusing nip to avoid wrinkling.

SUMMARY OF THE INVENTION

It is an aspect of the present invention to provide a method and apparatus for transporting media through a fusing nip in an image forming apparatus to reduce wrinkling of the media.

It is a feature of the present invention that the method and apparatus pre-stress media prior to the fusing nip to compensate for a nip stress imparted on the media by the fusing nip.

It is another feature of the present invention that the method and apparatus control media entry into the fusing nip to create the pre-stress.

It is yet another feature of the present invention that the method and apparatus utilize a media support surface positioned upstream from the fusing nip to guide the media into the nip in a manner that imparts the pre-stress on the media.

It is still another feature of the present invention that the end of the support surface nearest the nip is spaced from a nip-induced curvature of the media.

It is an advantage of the present invention that the method and apparatus achieve reduced media wrinkling without creating related paper transport problems, such as leading edge smear or trailing edge tail flip.

It is another advantage of the present invention that the method and apparatus may be utilized with multiple nip geometries.

Still other aspects, features, and advantages of the present invention will become apparent to those skilled in this art from the following description, wherein there is shown and described a preferred embodiment of this invention, simply by way of illustration of one of the modes best suited to carry out the invention. As it will be realized, the invention is capable of other different embodiments and its several details are capable of modifications in various, obvious aspects, all without departing from the invention. Accordingly, the drawings and descriptions will be regarded as illustrative in nature and not as restrictive. And now for a brief description of the drawings.

BRIEF DESCRIPTION OF THE DRAWINGS

FIG. 2 is a simplified schematic view of a pair of fusing rollers forming a fusing nip and a pre-nip media support surface for guiding media toward the fusing nip.

FIG. 3 is an enlarged illustration showing a piece of media traveling through the fusing nip, with the nip creating a nip-induced curvature in the media.

FIG. 4 is a partial view of a trailing end of an envelope showing wrinkling near the trailing end caused by fusing nip stress.

FIG. 5 is an enlarged side view of the media support surface and fusing rollers showing a piece of media advancing over the support surface.

FIG. 6 is a schematic side view showing the pre-nip bending of the media as the media travels through the fusing nip.

FIG. 7 is an isolated view of the media of FIG. 6 showing the path of the media through the fusing nip.

Reference will now be made in detail to the present preferred embodiment of the invention, an example of which is illustrated in the accompanying drawings.

DETAILED DESCRIPTION OF THE PREFERRED EMBODIMENT

Figure 1:
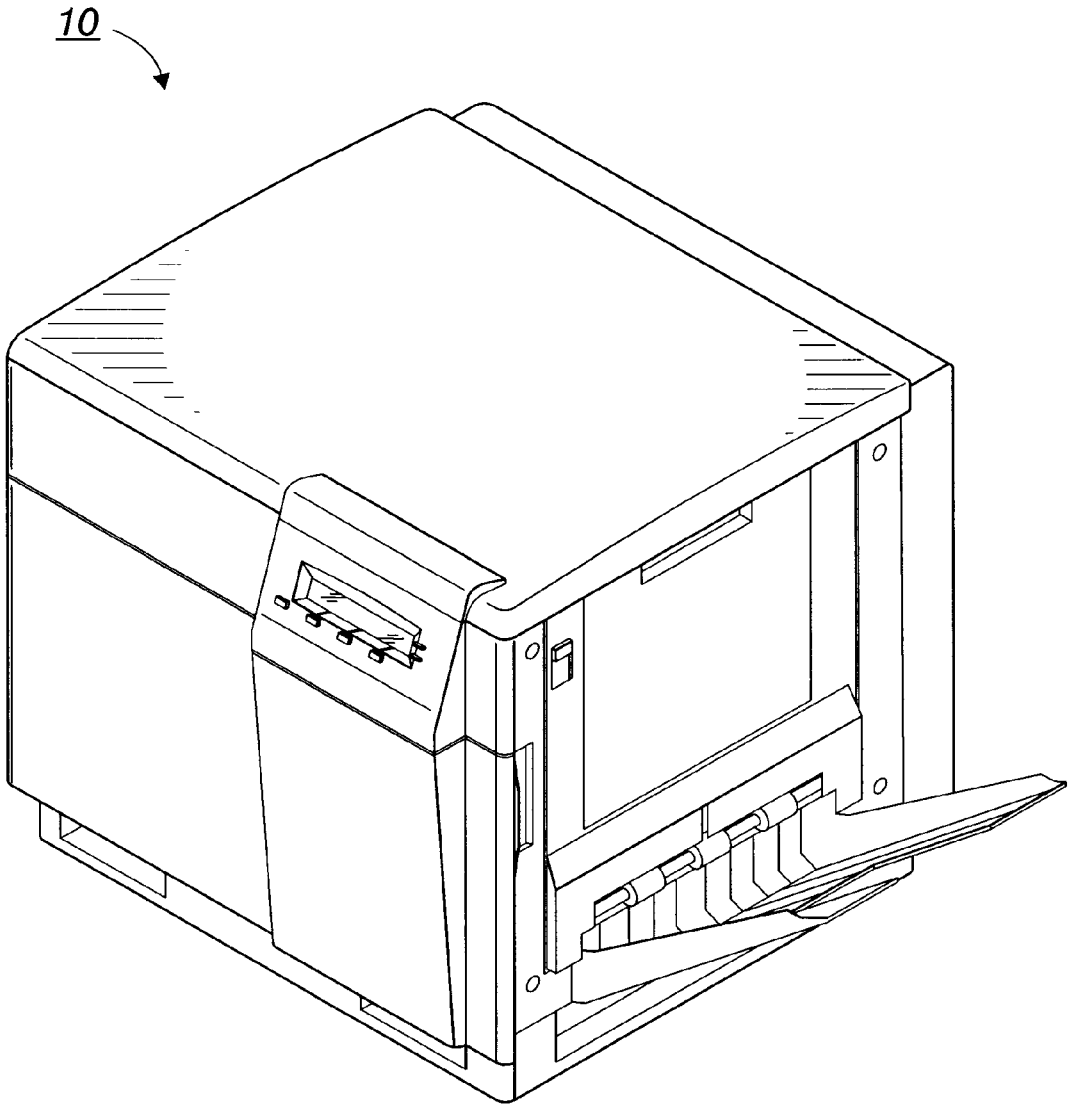
FIG. 1 is an overall perspective view of a color electrophotographic printer that utilizes the method and apparatus of the present invention.

FIG. 1 is an overall perspective view of a color electrophotographic printer or a laser printer 10 that utilizes the method and apparatus of the present invention. It will be appreciated that the present invention may be practiced with and embodied in various other imaging apparatus that utilize a fusing nip to fuse an image into a substrate, such as photocopiers, ink jet printers and the like. Accordingly, the following description will be regarded as merely illustrative of one embodiment of the present invention.

FIGS. 2 and 3 are schematic illustrations of a fusing nip 14 formed by biasing a heated roller 16 against a pressure roller 18. In the embodiment shown, the pressure roller 18 has a surface hardness that is greater than the surface hardness of the heated roller 16. As best seen in FIG. 3, the softer surface of the heated roller 16 is deformed by contact with the harder surface of the pressure roller 18. As explained above, this difference in hardness between the fusing rollers causes differential nip velocities that create a nip stress within the fusing nip. As shown in FIG. 3, this nip stress imparts a bending moment on media 20 traveling through the nip 14 that causes a nip-induced curvature in the media 20. The nip-induced curvature shown in FIG. 3 bends or curls the media toward the harder pressure roller 18.

The differential nip velocities within the nip 14 also tend to move the upper surface 22 of the media 20 at a faster velocity than the lower surface 24. With reference now to FIG. 4, when an envelope 30 is fed through the fusing nip 14 with its long edge 31 parallel to the direction of travel A, these differential nip velocities and the nip stress cause wrinkles 32 near a trailing end 34 of the envelope where the upper surface 22 of the envelope is affixed to the lower surface 24. It will also be appreciated that the tension or stress created on the top surface 22 of the media 20 or envelope 30 due to the unequal nip velocities acts in a direction generally parallel to the direction of travel A of the media through the nip.

Figure 8:
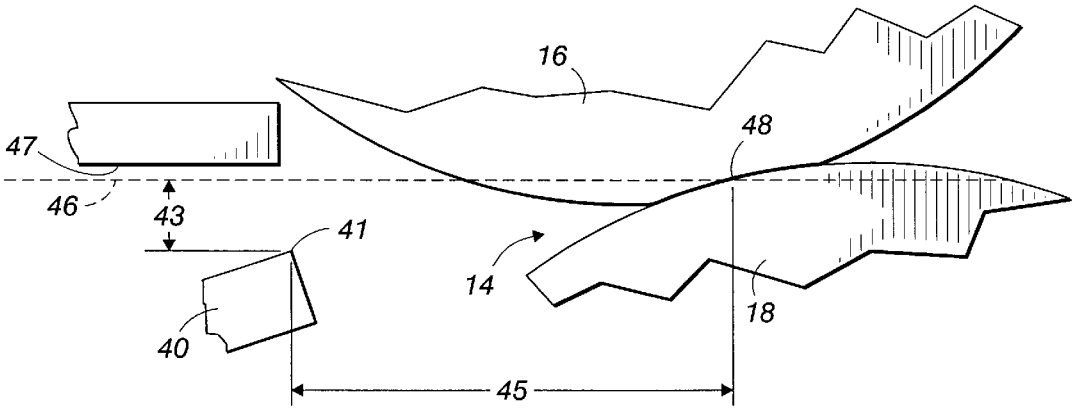
FIG. 8 is an enlarged side view of the media support surface showing its position relative to the fusing rollers.

With reference now to FIGS. 2 and 8, to avoid the accumulation of excess stress on the media 20 as it travels through the fusing nip 14, and in an important aspect of the present invention, a media support surface 40 is positioned relative to the fusing rollers 16, 18 such that the media is bent in a direction opposite to the curvature of the hard pressure roller 18 prior to the media entering the nip 14. This pre-nip bending compensates for and substantially opposes the bending moment imparted on the media 20 by the rollers 16, 18 in the nip 14. Advantageously, this pre-nip bending minimizes the relative slip between the top surface 22 and the bottom surface 24 of the media 20. Alternatively expressed, the accumulated stress between the top and bottom surfaces 22, 24 is minimized at the exit of the nip 14, thereby reducing and substantially eliminating wrinkling.

With reference now to FIG. 5, a preferred embodiment of the media transport apparatus of the present invention will now be described. The media support surface 40 is positioned upstream from the fusing nip 14 and is angled upwardly with respect to a horizontal reference line 46 that passes through the center point 48 of the nip. To achieve the pre-nip bending of the media 20 as described above, the media support surface 40 is positioned to direct the leading edge 21 of the media into contact with the heated roller 16 prior to the media entering the fusing nip 14. In this manner, as the media is advanced toward the fusing nip 14, the media 20 follows the curvature of the heated roller 16 as it enters the nip.

FIGS. 6 and 7 illustrate the media path through the fusing nip. As shown in FIG. 6, after the media 20 first contacts the heated roller 16, the media is urged downwardly with respect to a tangential line of contact 17 extending through the center point 48 of the nip 14 between the heated roller and the pressure roller 18. As best seen in FIG. 7, this media path creates a bend 23 prior to the center point 48 of the nip 14, the bend having a curvature opposite to the curvature of the pressure roller 18. As discussed above, this pre-nip bending compensates for the nip stress encountered by the media 20 within the nip 14.

With reference now to FIG. 8, in the preferred embodiment the media support surface 40 is positioned such that an end 41 closest to the fusing nip 14 is positioned a vertical distance 43 below the center point 48 of the nip. The vertical distance 43 is preferably between about 1 millimeter and about 6 millimeters, and most preferably about 2 millimeters. Advantageously, this positioning of the support surface 40 relative to the rollers 16, 18 induces sufficient pre-nip bending of the media 20 to effectively reduce wrinkling. This positioning also allows the leading edge 21 of the media 20 to move smoothly into the nip 14, and prevents the leading edge from pausing on the surface of the pressure roller 16 as the media is advanced, and then abruptly snapping forward into the nip. This abrupt movement of the leading edge 21 can smear the portion of the image near the leading edge, a phenomenon known as "leading edge smear".

The end 41 of the media support surface 40 is also spaced a horizontal distance 45 from the center point 48 of the nip 14. Preferably, the horizontal distance 45 is between about 10 millimeters and about 50 millimeters, and most preferably about 25 millimeters. Advantageously, this horizontal positioning of the media support surface 40 allows for the desired pre-nip bending, while also avoiding the problem of trailing edge tail flip. Tail flip occurs when the trailing edge of the media 20 flips upwardly from the media support surface 40 and contacts an adjacent surface 47 along the paper path. This contact can cause smearing of the unfused toner or ink near the bottom edge of the media.

In summary, the apparatus and method of the present invention reduce media wrinkling, especially in envelopes, by pre-bending the media prior to the media traveling through the fusing nip. This advantage in transporting media is achieved while also avoiding related media transport problems such as leading edge smear and trailing edge tail flip.

The foregoing description of a preferred embodiment of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different printing apparatus, other than solid ink offset printer, all without departing from the inventive concepts disclosed herein.

The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when the claims are interpreted in accordance with breadth to which they are fairly, legally, and equitably entitled. All patents cited herein are incorporated by reference in their entirety.

What is claimed is:

1. A method of transporting sheet media through a fusing nip in an image forming apparatus to reduce wrinkling of the sheet media, the method comprising the steps of:

providing a fusing nip formed by a first roller contacting a second roller, the first roller having a first hardness and the second roller having a second hardness, the first hardness being greater than the second hardness such that the fusing nip tends to bend the sheet media in a first direction; and advancing the sheet media so that the sheet media contacts the second roller at an oblique angle whereby the sheet media is bent in a second direction opposite to the first direction prior to the sheet media entering the fusing nip, whereby sheet media wrinkling is reduced.

2. The method of transporting sheet media through a fusing nip of claim 1, wherein the step of bending the sheet media in a second direction further comprises the step of supporting the sheet media upstream from the fusing nip at a position spaced from a nip-induced curvature of the sheet media created by the fusing nip.

3. The method of transporting sheet media through a fusing nip of claim 2, wherein the step of supporting the sheet media upstream from the fusing nip further comprises the step of providing a sheet media support surface positioned upstream from the fusing nip, the sheet media support surface having an end adjacent to the fusing nip, the end being spaced from the nip-induced curvature of the sheet media.

4. The method of transporting sheet media through a fusing nip of claim 3, further comprising the step of positioning the end of the sheet media support surface a vertical distance below a center point of the fusing nip.

5. The method of transporting sheet media through a fusing nip of claim 4, further including the step of positioning the end of the sheet media support surface a vertical distance of between about 1 mm and about 6 mm below the center point of the fusing nip.

6. The method of transporting sheet media through a fusing nip of claim 5, further including the step of spacing the end of the sheet media support surface a horizontal distance of between about 10 mm and about 50 mm from the center point of the fusing nip.

7. The method of transporting sheet media through a fusing nip of claim 1, further comprising the step of:

after a leading edge of the sheet media contacts the second roller prior to entering the fusing nip, advancing the leading edge of the sheet media downwardly with respect to a tangential line of contact between the first roller and the second roller, the tangential line of contact extending through the center point of the nip.

8. The method of transporting sheet media through a fusing nip of claim 1, wherein the step of bending the sheet media in a second direction further comprises the step of stressing the sheet media in a direction parallel to a direction of travel of the sheet media.

9. A sheet media transport apparatus for reducing sheet media wrinkling in an image forming apparatus, the sheet media transport apparatus comprising:

a fusing nip formed by a first roller contacting a second roller, the first roller having a first hardness and the second roller having a second hardness, the first hardness being greater than the second hardness such that the fusing nip tends to bend the sheet media in a first direction, the fusing nip including a center point;

a sheet media path that extends through the fusing nip; and a sheet media support surface positioned upstream from the fusing nip, the sheet media support surface having an end adjacent to the fusing nip, then being spaced from a nip-induced curvature of the sheet media created by the fusing nip, whereby the sheet media is advanced so that the sheet media contacts the second roller at an oblique angle whereby the sheet media is bent in a second direction opposite to the first direction prior to the media entering the fusing nip to reduce media wrinkling.

10. The sheet media transport apparatus of claim 9, wherein the end is positioned a vertical distance below the center point of the fusing nip.

11. The sheet media transport apparatus of claim 10, wherein the vertical distance is between about 1 mm and about 6 mm.

12. The media transport apparatus of claim 11, wherein the end of the sheet media support surface is spaced a horizontal distance of between about 10 mm and about 50 mm from the center point of the fusing nip.

* * * * *